US010888129B2

(12) United States Patent
Leatt et al.

(10) Patent No.: US 10,888,129 B2
(45) Date of Patent: Jan. 12, 2021

(54) NECK PROTECTION DEVICES

(71) Applicant: LEATT CORPORATION, Santa Clarita, CA (US)

(72) Inventors: Christopher James Leatt, Durbanville (ZA); Carel Sias Meyer, Durbanville (ZA); Cornelius Uys De Jongh, Durbanville (ZA)

(73) Assignee: LEATT CORPORATION, Santa Clarita, CA (US)

( * ) Notice: Subject to any disclaimer, the term of this patent is extended or adjusted under 35 U.S.C. 154(b) by 87 days.

(21) Appl. No.: 16/078,379

(22) PCT Filed: Feb. 22, 2017

(86) PCT No.: PCT/IB2017/050999
§ 371 (c)(1),
(2) Date: Aug. 21, 2018

(87) PCT Pub. No.: WO2017/145062
PCT Pub. Date: Aug. 31, 2017

(65) Prior Publication Data

US 2019/0053548 A1 Feb. 21, 2019

(30) Foreign Application Priority Data

Feb. 23, 2016 (GB) ..... 1603129.6

(51) Int. Cl.
*A41D 13/05* (2006.01)
*A42B 3/04* (2006.01)
*A41D 3/00* (2006.01)

(52) U.S. Cl.
CPC ..... *A41D 13/0512* (2013.01); *A41D 3/00* (2013.01); *A41D 13/0531* (2013.01);
(Continued)

(58) Field of Classification Search
CPC ..... A41D 13/015; A41D 13/0512; A41D 13/0531; A42B 3/04; A42B 3/0473; A61F 5/00; A61F 5/055; A61F 5/3707
(Continued)

(56) References Cited

U.S. PATENT DOCUMENTS 3,189,917 A 6/1965 Sims
3,497,872 A * 3/1970 Mitchell ..... A63B 71/10 2/468

(Continued)

FOREIGN PATENT DOCUMENTS

WO WO-2012113857 8/2012

OTHER PUBLICATIONS

International Search Report for PCT/IB2017/050999, dated May 24, 2017.

(Continued)

*Primary Examiner* — Katherine M Moran
(74) *Attorney, Agent, or Firm* — B. Aaron Schulman, Esq.; Stites & Harbison, PLLC

(57) ABSTRACT

A neck protection device (10) includes a ring (14) that is configured to extend around a wearer's neck and that includes a plurality of elements (12) each defining a passage (16). A tether (18) extends along the passages (16) and a tension device (38) is configured to grip the tether (18) releasably and hold it under tension. The elements (12) are free to move relative to one another, when the tether (18) is not under tension, so that the ring (14) is flexile and can be fitted around the neck, but the elements (12) are drawn into abutting relationship to form a stiff ring (14), when the tether (18) is under tension.

11 Claims, 4 Drawing Sheets

(52) U.S. Cl.
CPC ..... *A42B 3/0473* (2013.01); *A41D 2400/44* (2013.01); *A41D 2600/102* (2013.01)

(58) Field of Classification Search
USPC ..... 2/44, 45, 60, 129, 338, 415, 468; 128/857, 869, 873, 874; 602/18
See application file for complete search history.

(56) References Cited

U.S. PATENT DOCUMENTS

| | | | | |
|---|---|---|---|---|
| 4,501,023 | A | 2/1985 | Bilberry | |
| 4,870,705 | A * | 10/1989 | Higby | A41D 13/0512 2/468 |
| 8,562,551 | B2 | 10/2013 | Leatt et al. | |
| 2009/0144884 | A1 * | 6/2009 | Duncan | A42B 1/008 2/410 |
| 2010/0229290 | A1 | 9/2010 | Nelson | |
| 2014/0109287 | A1 * | 4/2014 | Ramirez | A42B 1/048 2/84 |
| 2016/0287424 | A1 * | 10/2016 | Webster | A61F 5/055 |

OTHER PUBLICATIONS

Written Opinion of the International Searching Authority for PCT/IB2017/050999, dated May 24, 2017.

* cited by examiner

NECK PROTECTION DEVICES

FIELD OF THE INVENTION

This invention relates to upper body garments with features intended to reduce the risk and/or severity of neck injury, during activities such as motorcycling, which require neck movement and pose risks of neck injury.

The neck protection device of the invention can also be used on its own, without forming part of a garment, and the invention is thus not necessarily limited to neck protection garments.

BACKGROUND TO THE INVENTION

Neck braces have been proposed in WO 2005/051251 for protecting participants in activities such as motorcycling, skiing and the like. Different variations of neck braces have been developed since publication of WO 2005/051251 and the most effective of these neck braces typically include a stiff (preferably rigid) ring that extends around the wearer's neck and a rearward extension that extends behind the wearer's back, along the upper spine.

These neck braces typically pivot so that the ring can open and be fitted around the wearer's neck, or part of the ring can be removed and clipped to the remainder of the ring, once fitted around the wearer's neck. In order for these neck braces to operate properly, they need to fit correctly in relation to the wearer's chest and spine, with appropriate proximity around the wearer's neck and with a space between the upper surface of the neck brace and the wearer's helmet.

The present invention seeks to allow fitting of neck protection devices around wearers' necks with suitable precision, in a convenient way. The invention also seeks to provide upper body garments with neck protection, which can be donned conveniently.

SUMMARY OF THE INVENTION

According to the present invention there is provided a neck protection device including:

- a ring that is configured to extend substantially around the neck of a wearer, said ring including a plurality of elements and a plurality of said elements each defining a passage;
- a tether extending along the passages defined in the elements of the ring; and
- a tension device that is configured to grip the tether releasably;
- said elements of the ring being free to move relative to one another, when the tether is not under tension and to be drawn into abutting relationship to form a stiff ring, when the tether is under tension.

The phrase "substantially around the neck of the wearer" includes a ring that extends contiguously around the neck, but the ring need not be continuous and the phrase also includes a ring that defines a gap that is smaller than the width of the neck and is preferably far smaller.

The term "stiff" refers to a condition in which the ring will retain its overall shape during normal use, this includes a ring that is hard and/or rigid, but it also includes a ring that may deform slightly, but not to the extent that it loses its overall shape.

At least some of the elements of the ring that are adjacent to each other, may form complementary surfaces that face each other and the complementary surfaces are drawn into abutment when the tether is under tension.

The passages may extend internally through said elements of the ring, so that the elements are held together by the tether in a flexible condition when the tether is not under tension.

Two or more of the elements of the ring may form gate elements that are releasably attachable to each other by a releasable closure device, without the tether extending between said two gate elements, i.e. the ring may be open between these two gate elements when the releasable closure device is open. One or both ends of the tether may be connected to the gate elements.

The neck protection device may form part of a garment and the releasable closure device may be a releasable closure device of the garment, such as a zipper. The garment may be an upper body garment such as a jacket and the neck protection device may form part of a collar of the garment.

The tension device may include a ratchet that is configured to apply tension to the tether and hold the tether under tension until the ratchet is released and the tension on the tether is released.

The thickness of one or more of the elements of the ring may be adjustable and this may be achieved by including one or more compressible layers in the element.

The neck protection device may include an extension that is configured to extend along the wearer's back, in the region of the upper spine.

BRIEF DESCRIPTION OF THE DRAWINGS

For a better understanding of the present invention, and to show how it may be carried into effect, the invention will now be described by way of non-limiting example, with reference to the accompanying drawings in which.

DETAILED DESCRIPTION OF THE DRAWINGS

Figure 1:
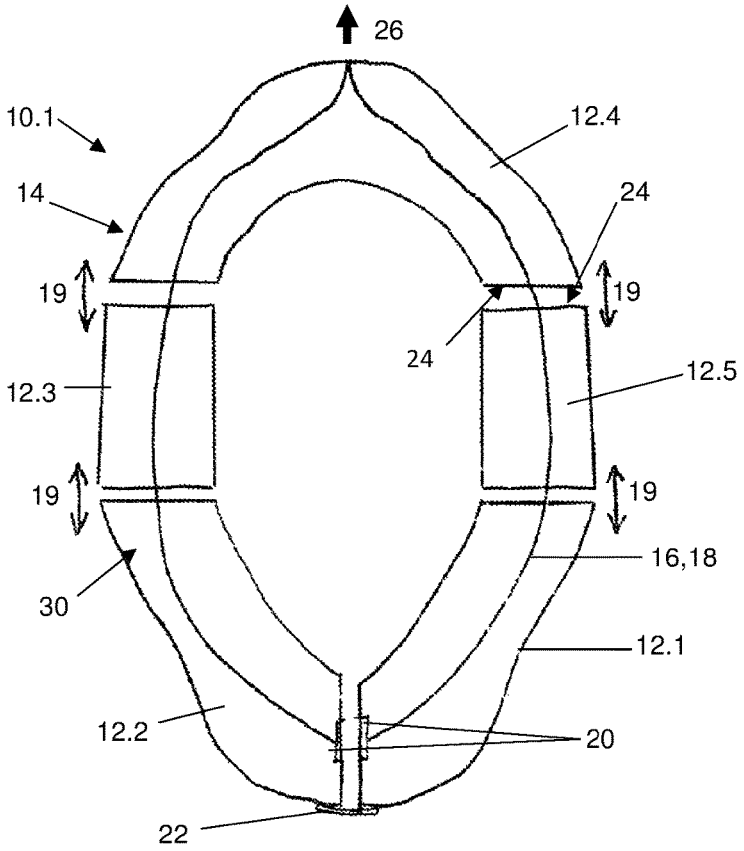
FIG. 1 shows a diagrammatic top view of a first embodiment of a neck protection device according to the present invention.

Referring to the drawings, a neck protection device according to the present is generally identified by reference number 10, with a suffix referring to the relevant embodiment of the invention. Features that are common between different embodiments of the invention, are identified by like reference numbers.

Figure 2:
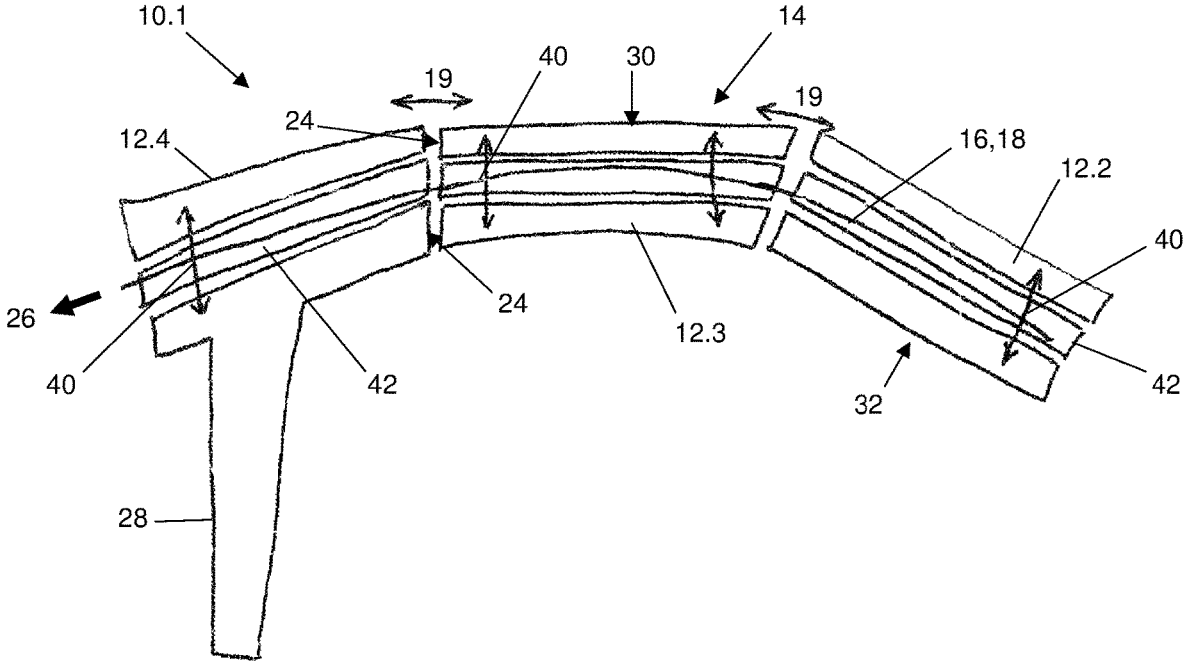
FIG. 2 shows a diagrammatic side view of the neck protection device of FIG. 1.

Referring to FIGS. 1 and 2, the neck protection device 10.1 comprises five elements 12, each identified by a suffix, which form a ring 14 when the elements are in close abutment, but they are shown spaced slightly apart in FIGS. 1 and 2. Each of the elements 12 defines a passage, which can be external to the element, but which is preferably an internal passage 16, and a tether 18 extends along the passages, preferably with sufficient play for the tether to slide along the passages. The tether 18 can be a single tether or can comprise two runs and preferably extends in a part-complete loop around the ring 14. In other embodiments, the ring 14 may include elements without passages and through which the tether does not extend, in addition to the elements 12.

The elements 12 are strung on the tether 18 such that, when the tether is not under tension, e.g. the tether is slack, the elements are spaced apart as shown in FIGS. 1 and 2, with the spacing between adjacent elements identified by arrows 19, or they can easily become spaced apart as the tether slides inside the passages 16. With the spacing 19 between adjacent elements 12, the elements can move relative to one another in a similar manner to beads on a string.

Two of the elements 12 form gate elements 12.1 and 12.2 and are at the front of the ring 14. The opposing ends of the tether 18 terminate in each of the gate elements 12.1 and 12.2, where they are connected to the gate elements by anchor formations 20, or the like. The tether 18 thus does not extend directly between the two gate elements 12.1 and 12.2 and the ring 14 is open between the gate elements, except when the gate elements are attached together by a releasable closure device such as a hook-and-loop fastener, a zipper 22, or other suitable closure device. In other embodiments, the gate elements are in positions along the ring 14, other than at the front of the ring. Further, in other embodiments, the tethers 18 do not terminate in the gate elements, but can be connected to the gate elements (e.g. a tether can loop around part of a gate element) and/or can terminate in other elements 12.

When the tether 18 is not under tension, the gate elements 12.1 and 12.2 can be separated by flexing the elements 12 relative to each other about the tether and thus flexing the ring 14 to open a gap between the gate elements. When the gate elements 12.1 and 12.2 have been separated, the ring 14 can be fitted fairly easily around the neck of a wearer or can be removed, with the wearer's neck passing through the gap between the gate elements 12.1 and 12.2, in much the same way as the collar of a garment.

The neck protection device 10 also includes a tension device that is configured to pull the tether 18 to place the tether under tension, or to keep the tether under tension. Various embodiments of tensioning devices could be used, but preferably, the tension device includes a self-locking mechanism such as a ratchet, e.g. a ratchet wheel.

The surfaces 24 of each adjacent pair of the elements 12 that face each other can be flat, as shown in FIGS. 1 and 2, or could have any other complementary or cooperating formations, and these surfaces are oriented such that the elements have the correct positions relative to each other, when the surfaces are in abutment, so that the elements form the ring 14.

When the tether 18 is pulled, e.g. by pulling it in the direction 26 with the ratchet wheel, or the like, the tether is placed under tension and pulls adjacent elements 12 into abutment along their surfaces 24. If sufficient tension is applied to the tether 18 and if the gate elements 12.1 and 12.2 are attached to each other by the zipper 22, the elements are held firmly against each other, so that the ring 14 is sufficiently stiff to serve the purpose of the ring of a neck brace as described in WO2005/051251. When tension in the tether 18 is released again, the elements 12 separate in the directions 19, and the ring 14 becomes flexible again.

Other features of the neck protection device 10 that can be seen in FIGS. 1 and 2, include a rearward extension 28 that is configured to extend along the wearer's back, in the region of the upper spine preferably to the thoracic region. The ring 14 has an upper surface or strike surface 30 that is normally spaced below the lower rim of a helmet worn by the wearer, by a sufficient distance to allow the wearer a range of freedom of movement, but the strike surface can make contact with the underside of the helmet in the event of pronounced neck movements. An underside 32 of the ring 14 is configured to rest on the wearer's shoulders and chest to transfer impact loads received from the helmet on the strike surface 30, to the wearer's body. These features are described in WO 2005/051251.

Figure 3:
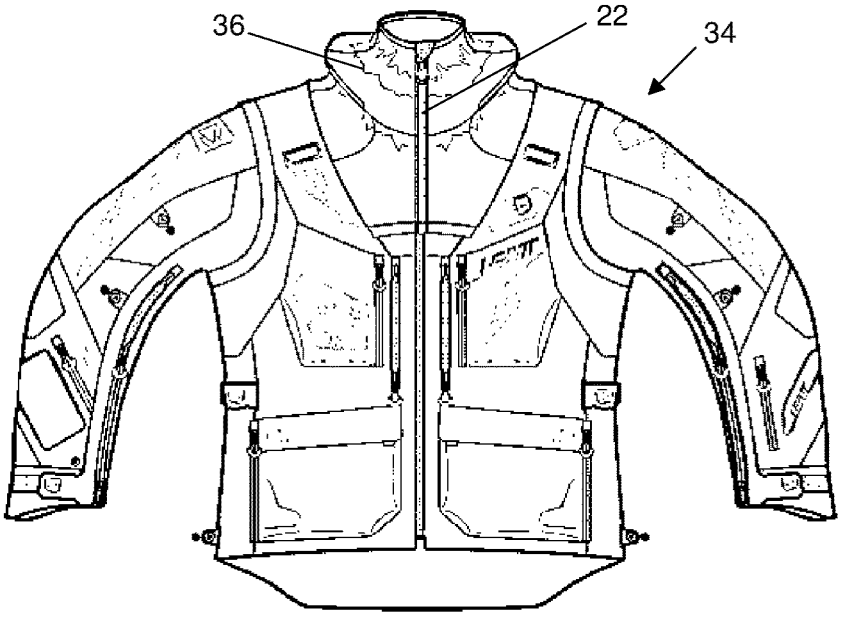
FIG. 3 shows a diagrammatic front view of a garment according to the present invention, including the neck protection device of FIG. 1.
Figure 4:
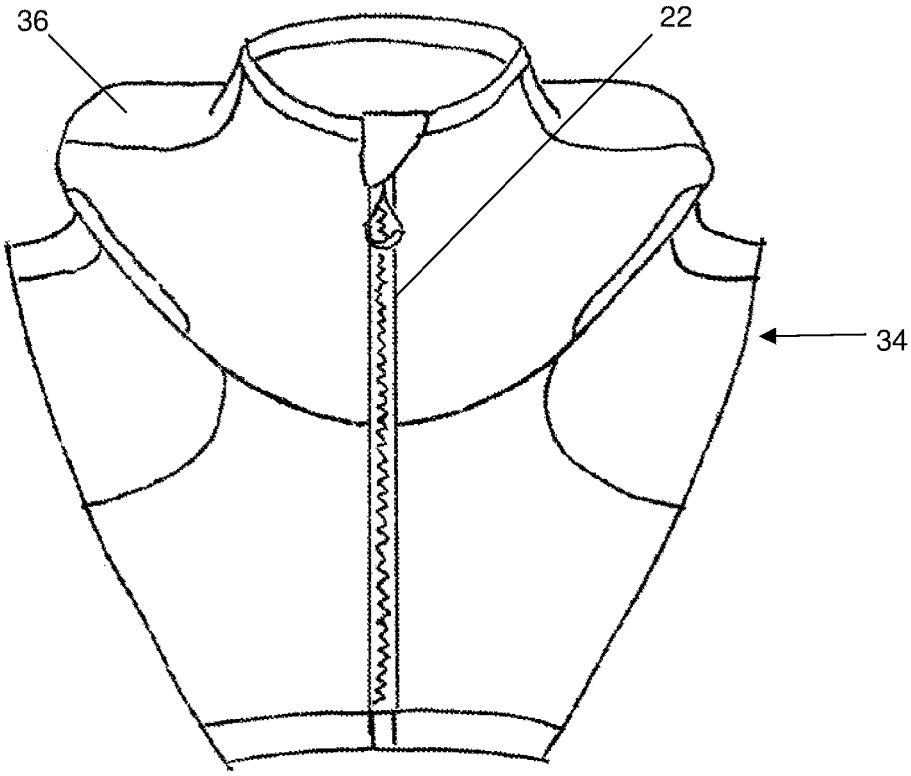
FIG. 4 shows a detail diagrammatic front view collar region of the garment of FIG. 3.

Referring to FIGS. 3 and 4, the neck protection device 10.1 of FIGS. 1 and 2, can form part of an upper body garment such as a jacket 34, with the ring 14 being integrated into the jacket, e.g. in a collar 36 of the jacket. The zipper 22 that attaches the gate elements 12.1 and 12.2 together is the zipper of the jacket 34 and the fabric of the jacket preferably extends over the ring 14 completely.

If a user wants to don the jacket 34, the tether 18 is not under tension and/or its tension is released so that it is sufficiently slack for the elements 12 to flex relatively freely. The zipper 22 is opened and the jacket 34 is donned in the usual manner, with the ring 14 in an open, flexible state, forming part of the collar 36.

When the jacket 34 is in position, the zipper 22 is closed all the way to the top, so that the gate elements 12.1 and 12.2 are attached to each other. The tether 18 is placed under tension by operating the ratchet wheel (not shown in FIGS. 3 and 4), until the tether is under sufficient tension and is held in tension by the ratchet wheel, so that the ring 14 is substantially rigid and can serve its purpose as described in WO 2005/051251.

To remove the jacket 34, the user simply releases the ratchet wheel, to release tension in the tether 18 and to allow the ring 14 to become flexible (as described above) and the user can undo the zipper 22, open the jacket and remove the jacket, as normal.

In some embodiments of the invention, some of the elements 12, or all of them, can be configured so that their thickness or the height of the ring 14 is adjustable in the direction identified by arrows 40 in FIG. 2. The adjustment can be configured to extend along all the elements 12, simultaneously, or only in selected elements. This can be achieved in various ways, e.g. by providing an elastically compressible middle layer 42 that is sandwiched between harder layers that form the strike surface 30 and underside 32 of the ring 14. The thickness of the elements 14 can be adjusted by pulling the upper and lower layers together with a tether or cable mechanism, to compress the middle layer, rolling material into place, or the like.

The thickness adjustment in direction 40 allows adjustment of the neck protection device 10 to provide a correct fit on the wearer and to adjust the distance between the strike surface 30 and the underside of the wearer's helmet, to optimise functionality of the neck protection device, while ensuring comfort.

Adjustment of the thickness of elements 12 can be done when required, but it needn't be undone each time the jacket 34 is taken off. Accordingly, the thickness of the elements 12 can be adjusted for a particular wearer's physique and a particular helmet and can be kept in that state for repeated use until adjustment is required for a different user or different helmet.

Figure 5:
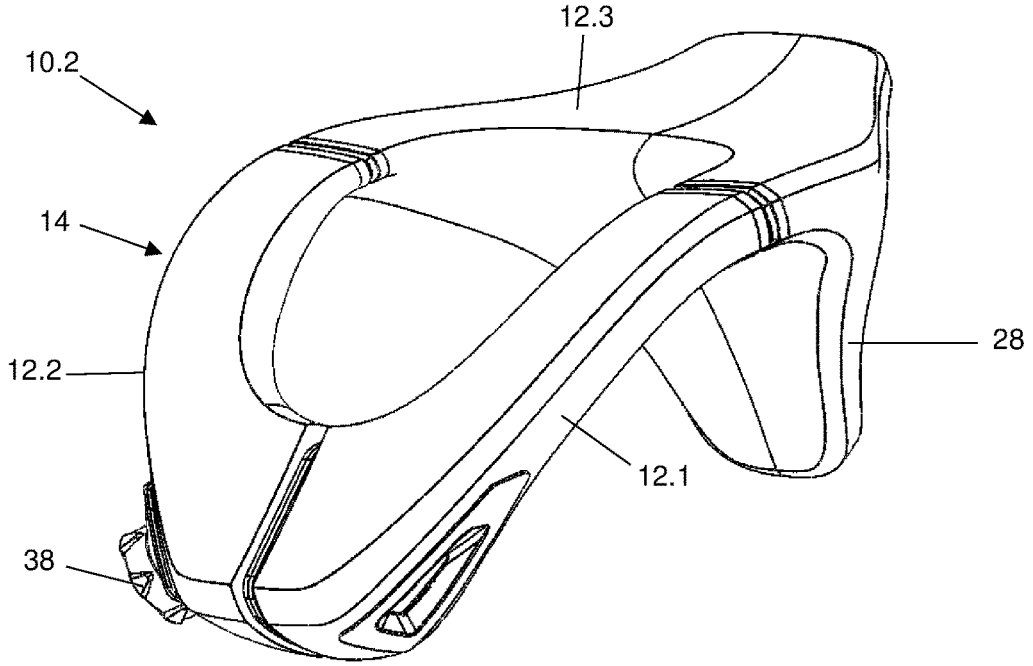
FIG. 5 shows a left, front, three-dimensional view of a second embodiment of a neck protection device according to the present invention.
Figure 6:
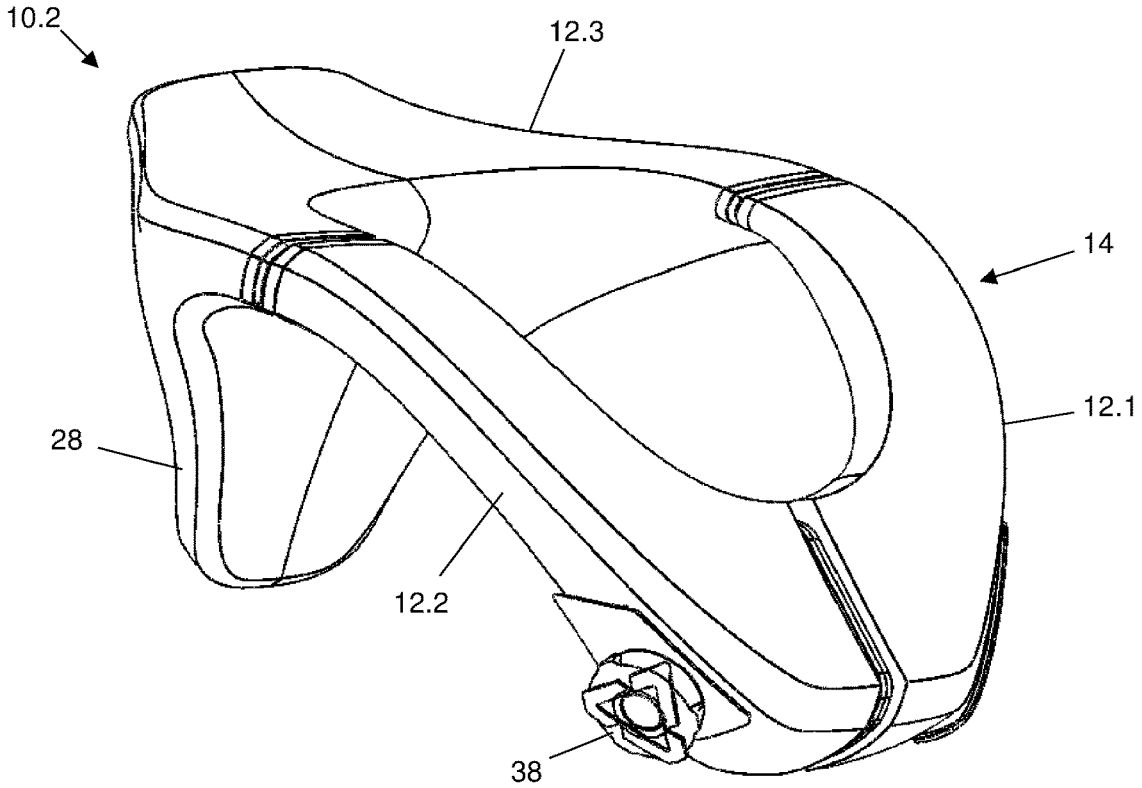
FIG. 6 shows a right, front, three-dimensional view of the neck protection device of FIG. 5.
Figure 7:
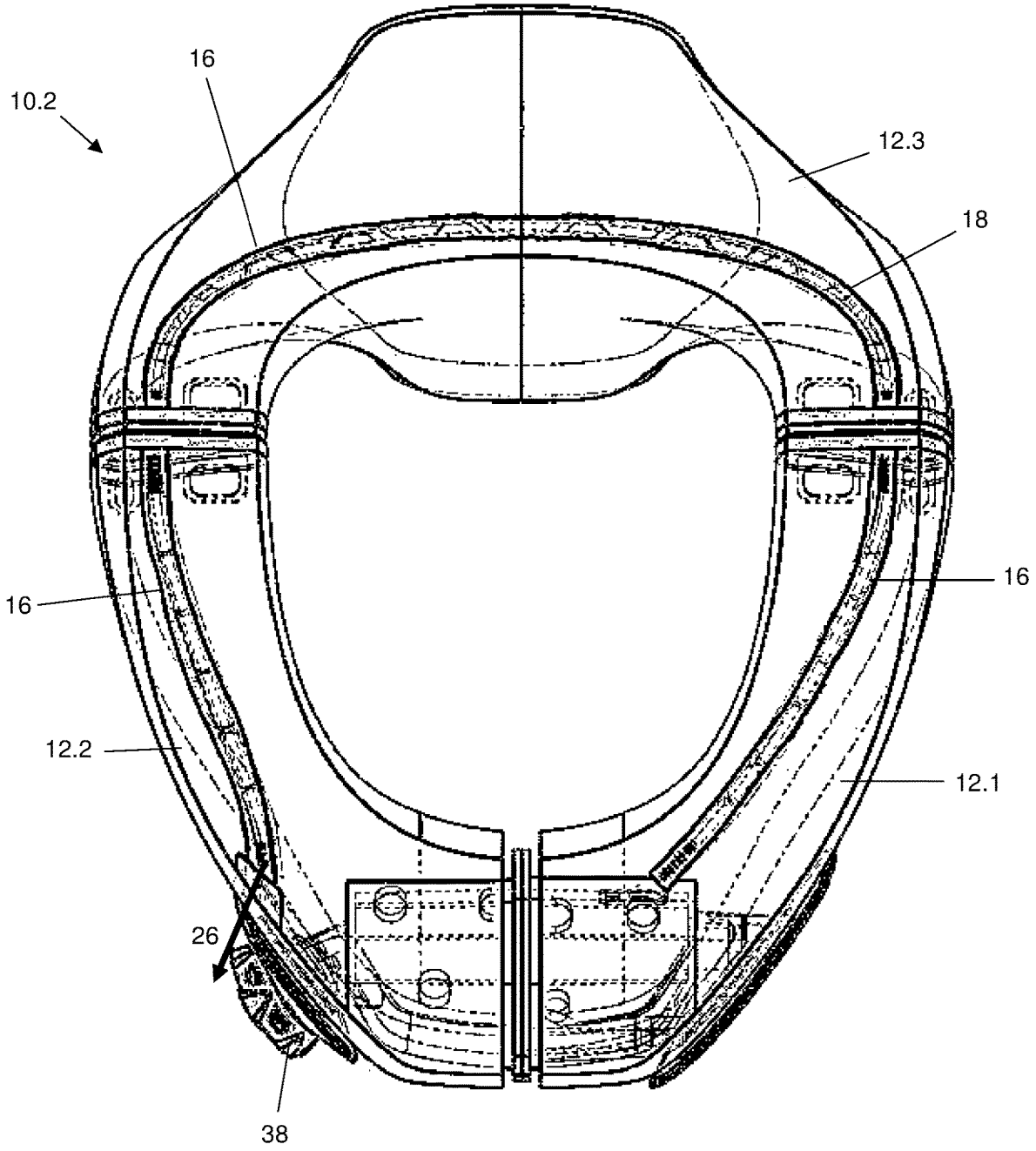
FIG. 7 shows a top view of the neck protection device of FIG. 5.

FIGS. 5 to 7 show a second embodiment of a neck protection device 10.2 according to the present invention. The neck protection device 10.2 includes elements 12 that form a ring 14, with a rearward extension 28 in the region of the thoracic spine substantially as described with reference to FIGS. 1 and 2. However, the ring 14 of the device 10.2 comprises only three elements 12, including two gate elements 12.1 and 12.2 at the front of the device, and a rear element 12.3 at the rear of the device.

A ratchet wheel 38 is provided on a right gate element 12.2 and is attached to a tether 18 that extends from the ratchet wheel along internal passages 16 defined inside the right gate element, the rear element 12.3 and a left gate element, where it terminates and is anchored inside the left gate element. The ratchet wheel 38 is easily accessible and can be operated easily by turning it by hand to apply tension to the tether 18 in the direction 26 and uses an internal ratchet mechanism to hold the tether under tension until the ratchet is released, e.g. by pulling an element of the wheel, or rotating it in an opposite direction. In other embodiments of the invention, various other forms of tension devices can be used instead of the ratchet wheel 38 and they can apply tension to the tether 18 at different locations on the ring 14 and/or in different directions.

The neck protection device 10.2 can also be used in various application on its own and/or as part of other equipment and can be integrated into the collar 36 of a jacket 34, as described above with reference to FIGS. 3 and 4.

Referring to all the drawings, the invention holds the advantages of allowing a user to fit the neck protection device 10 easily and conveniently while donning the jacket 34, without the need to fit a neck brace separately. The neck protection device 10 is also neatly and conveniently integrated with the jacket 34 and the jacket is configured to avoid interference with the operation of the neck protection device.

In addition, the elements 12 can be made of suitable materials to provide a suitably stiff neck protection device 10 that can be worn without integration into a jacket 34 or garment collar 36.

The invention claimed is:

1. A neck protection device comprising:

a ring that is configured to extend substantially around the neck of a wearer, said ring having an upper strike surface spaced below a lower rim of a helmet worn by the wearer by a sufficient distance to allow the wearer a range of freedom of head movement, wherein said upper strike surface is configured to make contact with the lower rim of the helmet in the event of pronounced head movements by the wearer, said ring including a plurality of elements and a plurality of said elements each defining a passage;

a tether extending along the passages defined in the elements of the ring; and a tension device that is configured to grip the tether releasably;

said elements of the ring being spaced apart and free to move relative to one another, such that the ring is flexible when the tether is not under tension, and said elements being configured to be drawn into an abutting relationship to form a substantially rigid ring, when the tether is under tension.

2. The neck protection device according to claim 1, wherein at least some of the elements of the ring that are adjacent to each other, form surfaces that face each other, said surfaces being drawn into abutment when the tether is under tension.

3. The neck protection device according to claim 1, wherein the passages extend internally through at least some of said elements of the ring, said elements being held together by the tether.

4. The neck protection device according to claim 1, wherein at least two of the elements of the ring form gate elements that are releasably attachable to each other by a releasable closure device, without the tether extending between said two gate elements.

5. The neck protection device according to claim 4, wherein at least one end of the tether is connected to one of the gate elements.

6. The neck protection device according to claim 4, wherein the neck protection device forms part of a garment and the releasable closure device is a releasable closure device of the garment.

7. The neck protection device according to claim 6, wherein the garment is an upper body garment and the neck protection device forms part of a collar of the garment.

8. The neck protection device according to claim 1, wherein the tension device includes a ratchet that is configured to place the tether under tension and hold the tether under said tension, until the ratchet is released and the tension on the tether is released.

9. The neck protection device according to claim 1, wherein the thickness of at least one of the elements of the ring is adjustable.

10. The neck protection device according to claim 9, wherein at least one of the elements of the ring includes at least one compressible layer.

11. The neck protection device according to claim 1, wherein the neck protection device includes an extension that is configured to extend along a wearer's back, in an upper spine region.

* * * * *